US007427710B2

(12) United States Patent
Hara

(10) Patent No.: US 7,427,710 B2
(45) Date of Patent: Sep. 23, 2008

(54) PICKUP APPARATUS

(75) Inventor: Koji Hara, Hamamatsu (JP)

(73) Assignee: Roland Corporation, Hamamatsu (JP)

( * ) Notice: Subject to any disclaimer, the term of this patent is extended or adjusted under 35 U.S.C. 154(b) by 235 days.

(21) Appl. No.: 11/260,774

(22) Filed: Oct. 27, 2005

(65) Prior Publication Data

US 2006/0150806 A1 Jul. 13, 2006

(30) Foreign Application Priority Data

Jan. 7, 2005 (JP) ..... 2005-002001

(51) Int. Cl.
*G10H 3/00* (2006.01)

(52) U.S. Cl. ..... 84/723; 84/725; 84/728

(58) Field of Classification Search ..... None
See application file for complete search history.

(56) References Cited

U.S. PATENT DOCUMENTS 5,292,998 A * 3/1994 Knapp ..... 84/726
5,292,999 A * 3/1994 Tumura ..... 84/728
5,391,832 A * 2/1995 Lace ..... 84/726
5,792,973 A * 8/1998 Riboloff ..... 84/726
6,846,981 B2 * 1/2005 Devers ..... 84/728
2007/0056435 A1 * 3/2007 Juszkiewicz et al. ..... 84/726

* cited by examiner

*Primary Examiner*—Marlon T Fletcher
(74) *Attorney, Agent, or Firm*—Foley & Lardner LLP

(57) ABSTRACT

A pickup apparatus for independently detecting the vibrations of each of a plurality of strings, and an electronic stringed instrument utilizing the pickup apparatus. The pickup apparatus minimizes the crosstalk effects between the different pickups by positioning the pickups such that the magnetic force lines of each pickup is not parallel to or not in close proximity of the magnetic force lines of adjacent pickups. In one example, each pickup in the pickup apparatus is disposed at an angle with respect to the string and with respect to adjacent pickups. In another example, each pickup is disposed at an offset along the length direction of the strings relative to adjacent pickups. In yet another example, each pickup is disposed both at an angle and at an offset relative to adjacent pickups.

30 Claims, 6 Drawing Sheets

PICKUP APPARATUS

CROSS-REFERENCE TO RELATED PATENT APPLICATIONS

This application claims priority to Japanese patent application No. 2005-002001 (filed on Jan. 7, 2005 in Japan), which was assigned to the applicant and is incorporated herein by reference, in its entirety.

BACKGROUND OF THE INVENTION

Embodiments of the present invention relate generally to a pickup apparatus that independently detects the vibrations of a plurality of strings in a stringed instrument, a stringed instrument utilizing such a pickup apparatus and a method of arranging pickups on a stringed instrument.

For some time, pickup apparatuses that are used in guitar synthesizers have been formed such that the vibrations of each of the strings of the electric guitar are independently detected. FIG. 4 is a drawing that shows a portion of an electric guitar 100 on which a pickup apparatus 50 for a guitar synthesizer has been mounted.

As shown in FIG. 4, the pickup apparatus 50 has six pickups 21 (21*a*-21*f*) and is arranged with each of the pickups 21*a*-21*f* corresponding to each of the six strings 108 (108*a*-108*f*) positioned on the electric guitar body 104 facing the strings.

The pickup apparatus 50 can be affixed to the body 104 using double-sided tape, but may also be anchored to the body 104 via the screw holes 49 on both ends of the pickup apparatus 50 or some other means. The electrical signal detected by each of the pickups 21 is fed to the control apparatus 120 via a cable 106 and transmitted to the guitar synthesizer via another cable 125 connected to the control apparatus 120.

The pickup apparatus 60 is affixed by the manufacturer and placed on the electric guitar 100. The pickup apparatus 60 is formed with a coil that is common to all six strings. The electrical signal detected by the pickup apparatus 60 is output from the output jack 112 on the body 104.

One end of the six strings is anchored to the bridge 110. The bridge 110 is structured so as to pivot with a shaft (not shown in the drawings) as the center. In a state in which the tremolo arm 111 is not operated, the bridge is thrust in the direction in which the strings are stretched by a spring (not shown in the drawings). When the tremolo arm 111 is operated so as to be brought near the body 104, the bridge pivots with the shaft as the center against the tension of the spring, hence the tension applied to the strings becomes weaker and the vibration frequency of the strings becomes lower. Accordingly, it is possible to raise or lower the pitch by operating the tremolo arm 111.

The pickup apparatus 50 is mounted in the space between the pickup apparatus 60 and the bridge 110. In addition, the output jack 112 of the electric guitar 100 is connected to the control apparatus 120 via a cable 114. Another cable 125 outputs the electrical signal from the pickup apparatus 50 and an electrical signal that has either been synthesized or switched by the control apparatus 120.

Next, an explanation will be give regarding the pickup 21 while referring to FIG. 5. FIG. 5(*a*) is an oblique external view of the pickup 21, and FIG. 5(*b*) is an oblique exploded view of the pickup 21. This pickup 21 is known as a humbucking type that comprises a pole piece 31 formed from a permanent magnet that has the N pole facing the string, a pole piece 32 formed from a permanent magnet that has the S pole facing the string, a coil 35 which surrounds the periphery of the pole piece 31, a coil 36 which surrounds the periphery of the pole piece 32, and a permanent magnet 33 that links the pole pieces 31 and 32. The pole pieces 31 and 32 are positioned facing each other.

The coils 35 and 36 are wound in mutually opposite directions such that their phases are inverse to each other, and they are connected in series. As a result, when the string vibrates, an electromotive force is produced and the external inducement noise is denied.

SUMMARY OF THE DISCLOSURE

In the pickup apparatus 100 of the Patent Reference and described above, the adjacent pickups are positioned close to each other. Hence, when adjacent strings vibrate, the changes in the magnetic field formed by the pickup corresponding to one string affects the magnetic field formed by the pickup corresponding to the neighboring string. This produces an effect called crosstalk.

With a guitar synthesizer, the vibration of each string must be detected independently. The pitch and the amplitude for each string are detected from the vibration of that string in order to form a new musical tone in conformance with the vibration. Accordingly, when crosstalk is produced, it is not possible to accurately detect the pitch and amplitude of each string.

FIG. 6 is a planar drawing that shows pickups 21*a* and 21*b* that have been arranged respectively facing strings 108*a* and 108*b* from among the six strings. The magnetic force lines from the pole piece 31 (N pole) toward the pole piece 32 (S pole) are shown for each of the pickups 21*a* and 21*b*. When, for example, string 108*b* is plucked, the magnetic force lines of the pickup 21*b* are changed and the magnetic force lines of the adjacent pickup 21*a* are affected. As a result, an output can be detected from the pickup 21*a* even when the corresponding string 108*a* is not vibrating.

In addition, there is the problem that in those cases where both strings 108*a* and 108*b* are vibrating, the output of the pickup 21 is mixed due to the crosstalk effect, and it is not possible to accurately detect the pitch and amplitude of the vibration of each string.

The present invention solves the problems described above. One embodiment is a pickup apparatus with which it is possible to prevent the occurrence of crosstalk due to the vibrations of an adjacent string.

In order to achieve the above object, the pickup apparatus in the first preferred embodiment of the present invention is a pickup apparatus comprising a plurality of pickups that face each one of a plurality of strings to independently detect the vibrations of each string. The pickups are humbucking type pickups that has two magnetic poles, a N pole and a S pole, on the side that faces the string. The direction that the two magnetic poles face each other forms an angle of at least 20 degrees with respect to the length direction the strings. The adjacent pickups are arranged having the previously mentioned angle such that the directions that the two magnetic poles face are directions that are mutually reciprocal with respect to the direction of the length of the strings.

In the pickup apparatus in a second preferred embodiment of the present invention, the pickup apparatus of the first embodiment has the feature that the adjacent pickups are arranged in positions that differ with respect to the length direction of the strings. The difference in position is at least the amount of the distance between the two magnetic poles of each pickup.

The pickup apparatus in a third preferred embodiment is a pickup apparatus that comprises a plurality of four or more pickups that face each one of a plurality of strings to independently detect the vibrations of each string. The pickups are humbucking type pickups that each comprieses two magnetic poles, a N pole and a S pole, on the side that faces the string. The adjacent pickups are arranged in positions that differ along the length direction the pickup by at least the amount of the distance between the two magnetic poles of each pickup.

In the first preferred embodiment, the pickup is a humbucking type pickup with two magnetic poles on the side that faces the string, and the direction that the two magnetic poles face other each forms an angle of at least 20 degrees with respect to the length direction of the strings, and that adjacent pickups are arranged having the angle that the two magnetic poles face mutually reciprocal to the length direction of the strings. As a result, the direction of the magnetic force lines formed by the two magnetic poles, the N pole and the S pole, is at an angle at least 40 degrees with respect to the direction of the magnetic force lines of the adjacent pickup. Therefore, there is the advantageous result that a change in the magnetic force lines due to the vibration of the one string will have minimal effect on the adjacent pickup, and it is possible to prevent crosstalk.

A pickup apparatus in the second preferred embodiment is arranged such that the adjacent pickups are positioned different to each other along the length direction of the strings by at least the distance between the two magnetic poles. Accordingly, there is the advantageous result that the effect of a change in the magnetic force lines of one pickup on the adjacent pickup is further reduced.

In the pickup apparatus of the third preferred embodiment, the adjacent pickups are arranged in positions that differ along the length direction the strings by at least the distance between two magnetic poles. Hence, it is not likely that the magnetic fields formed by adjacent pickups will overlap, and there is the advantageous result that it is not likely that a pickup will be affected by a change in the magnetic force lines of an adjacent pickup due to the vibration of an adjacent string. Also, since the plurality of pickups is arranged with the pickups in positions that are mutually different along the length direction of the strings, it is possible to mount the apparatus between the existing pickup apparatus and bridge of the electric guitar without requiring a large space.

BRIEF DESCRIPTION OF THE DRAWINGS

FIG. 5(*a*) is an oblique view drawing that shows the exterior of a pickup, and FIG. 5(*b*) is an oblique exploded view drawing of a pickup.

DETAILED DESCRIPTION OF THE PREFERRED EMBODIMENTS

Figure 1A:
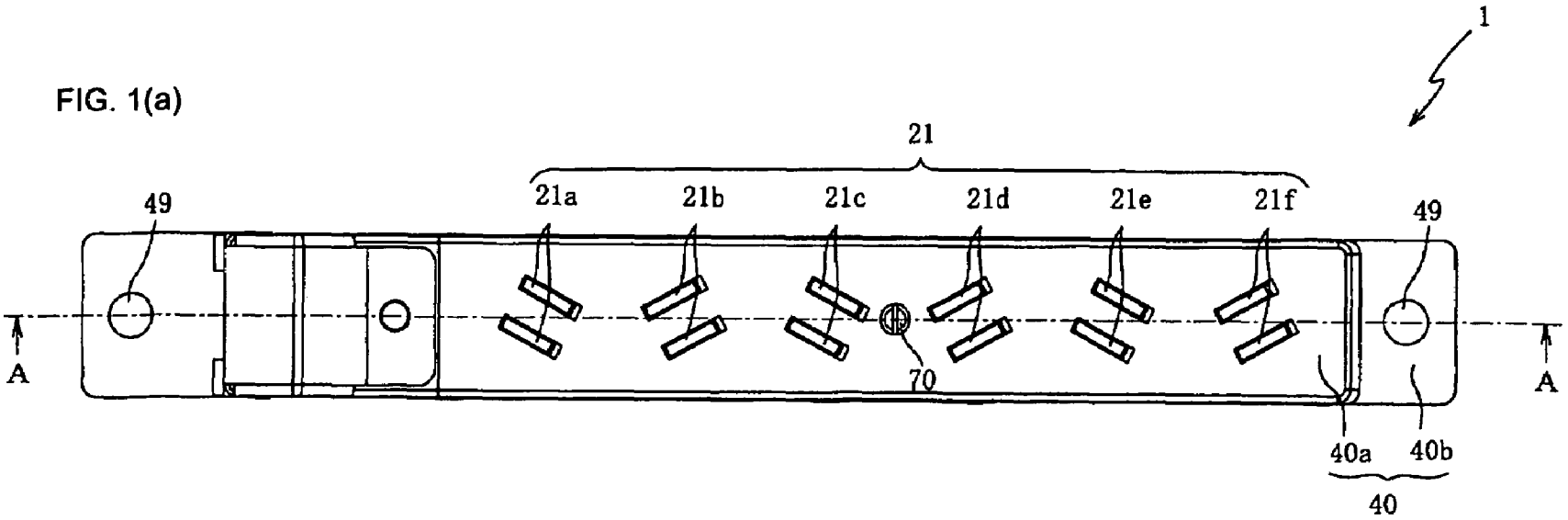
FIG. 1 is an external view drawing that shows the exterior of a pickup apparatus in accordance with an embodiment of the present invention.
Figure 1B:
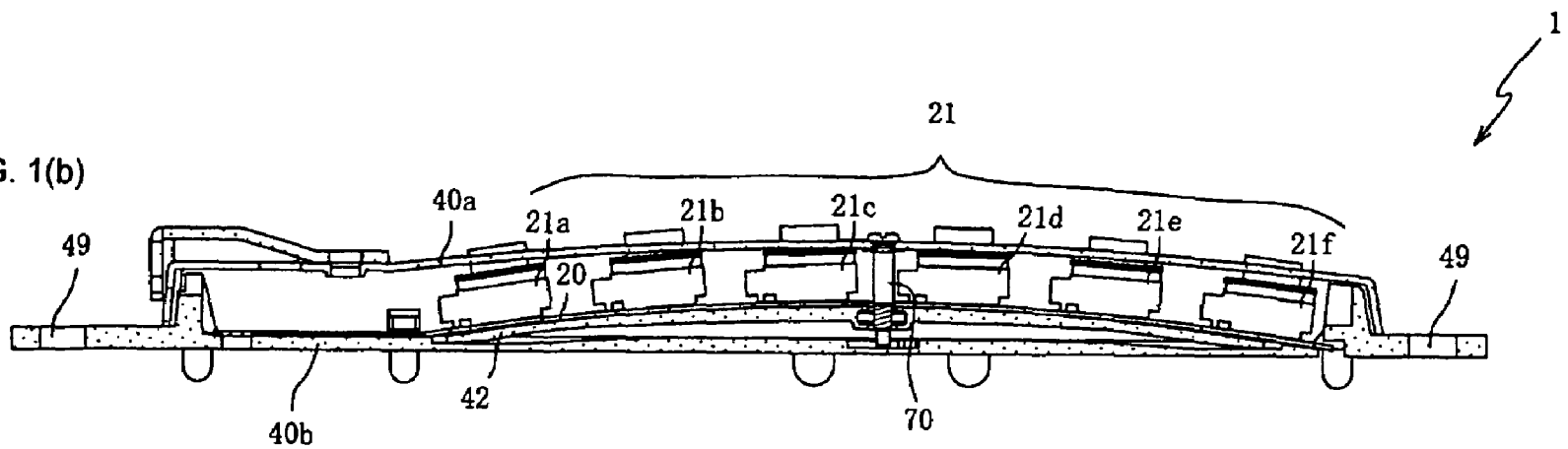

An explanation will be given below regarding a first preferred embodiment of the present invention while referring to the attached drawings. FIG. 1(*a*) is an external planar drawing of a pickup apparatus 1, and FIG. 1(*b*) is a cross-section drawing along the line A-A of FIG. 1(*a*). An explanation of the pickup apparatus 50 was given above, hence the explanations relating to portions with the same keys as described above for the pickup apparatus 50 are omitted. An explanation will only be given regarding the portions of the pickup apparatus 1 that are different from the pickup apparatus 50.

In the pickup apparatus 1, six pickups 21*a* through 21*f* are mounted on the pickup board 20, and the pickup board 20 is fastened by a leaf spring 42 housed inside the top case 40*a*. The top case 40*a* and the bottom case 40*b* comprise the case 40.

An adjusting screw 70 that adjusts the curvature of the leaf spring 42 is positioned roughly in the center of the pickup apparatus 1 along the length. With regard to the six strings 108 of the electric guitar 100, the curvature formed by the strings in the direction perpendicular to the strings differs depending on the manufacturer or the model of the electric guitar. However, by the adjustment of the adjusting screw, it is possible to adjust the distance between the pickups 21 and the strings to conform to each of the six strings 108.

The magnetic poles of the pickup 21 comprises a pole piece 31 which forms the N pole and another pole piece 32 which forms the S pole. In this embodiment, the direction which pole piece 31 faces pole piece 32 is positioned at an angle of 30 degrees from the length direction of the string. Moreover, the angles of adjacent pickups are in mutually opposite directions with respect to the length directions of the strings.

Figure 2:
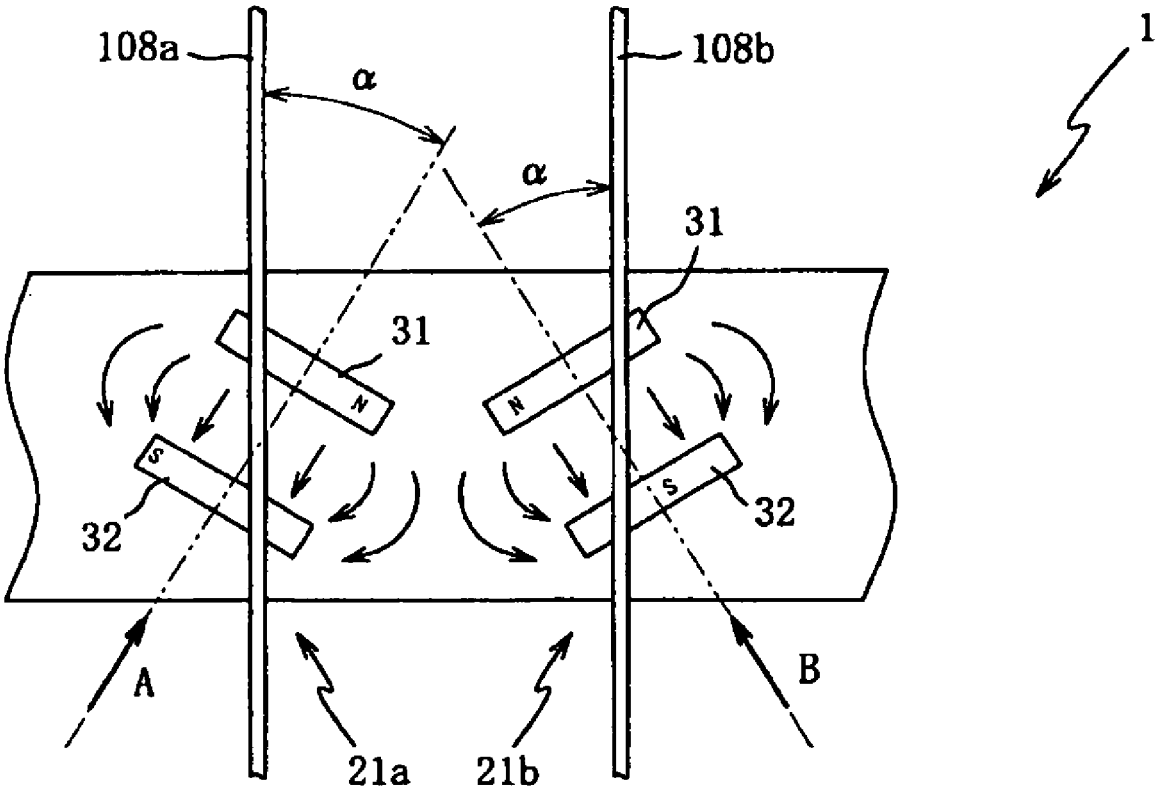
FIG. 2 is a drawing that shows an arrangement of pickups according to one embodiment of the present invention.

FIG. 2 is a planar drawing that shows the arrangement of the pickups in detail. For the pickup 21*a*, the direction A in which the pole piece 31 (N pole) faces pole piece 32 (S pole) is arranged having a clockwise angle a with respect to the length direction of the string 108*a*. On the other hand, for the pickup 21*b*, the direction B in which the pole piece 31 (N pole) faces the pole piece 32 (S pole) is arranged having a counterclockwise angle a with respect to the length direction of the string 108*b*.

As is shown in FIG. 2, the directions of the magnetic force lines formed by pickup 21*a* and pickup 21*b* have specific angles that do not become parallel. Accordingly, the density of the magnetic force lines of one pickup is low in the direction of the magnetic force lines of the other pickup. Hence it is possible to reduce the mutual crosstalk effects between the two pickups. In addition, since both the pickups 21*a* and 21*b* are arranged in roughly the same vertical position along the length of the strings 108, it is possible to form the pickup apparatus 1 with a narrow width. Therefore, even in those cases where the space on the electric guitar between the pickup 60 and the bridge 110 is narrow, it is possible to mount the pickup apparatus of the present embodiment on the electric guitar 100. In this embodiment of the present invention, the angle a has been made about 30 degrees in FIG. 2. However, it is possible to obtain the effect of the present invention by making the angle at least 20 degrees. The optimum value for this angle depends on the distance between the pole pieces 31 and 32, the distance between the strings, and other factors.

Next, an explanation will be given regarding another preferred embodiments of the present invention while referring to FIG. 3. Explanations for the portions that are the same as those of the first preferred embodiment and have the same keys have been omitted. An explanation will only be given regarding the portions that are different.

Figure 3A:
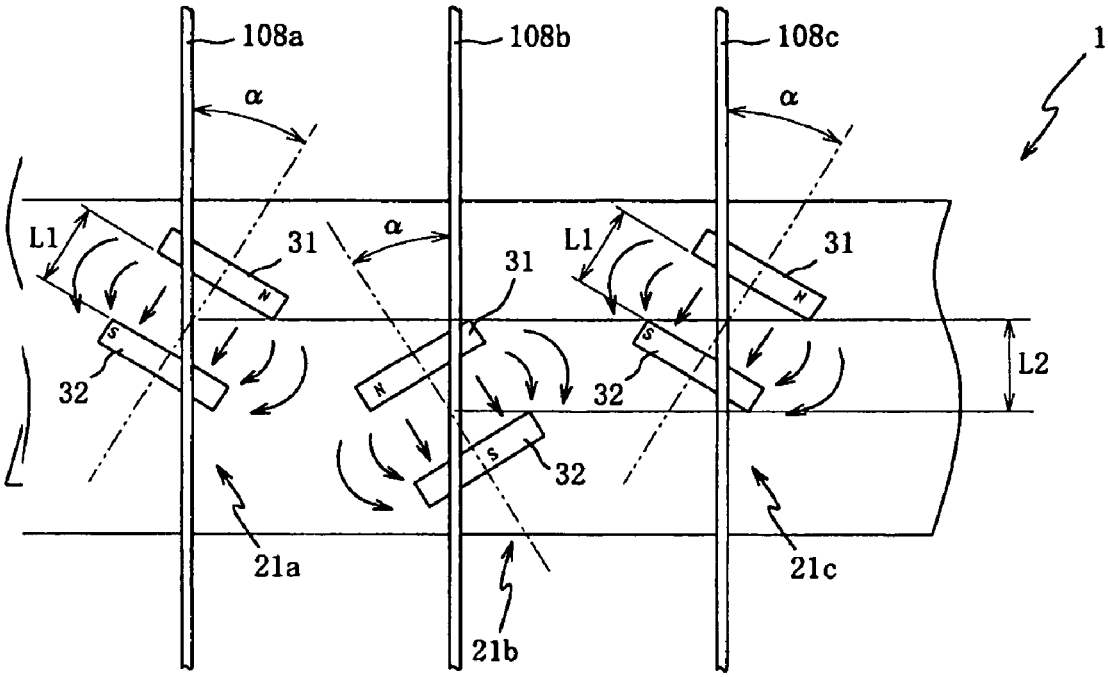
FIGS. 3(*a*) and 3(*b*) are drawings that respectively show an arrangement of pickups according to a second and a third embodiment of the present invention.
Figure 3B:
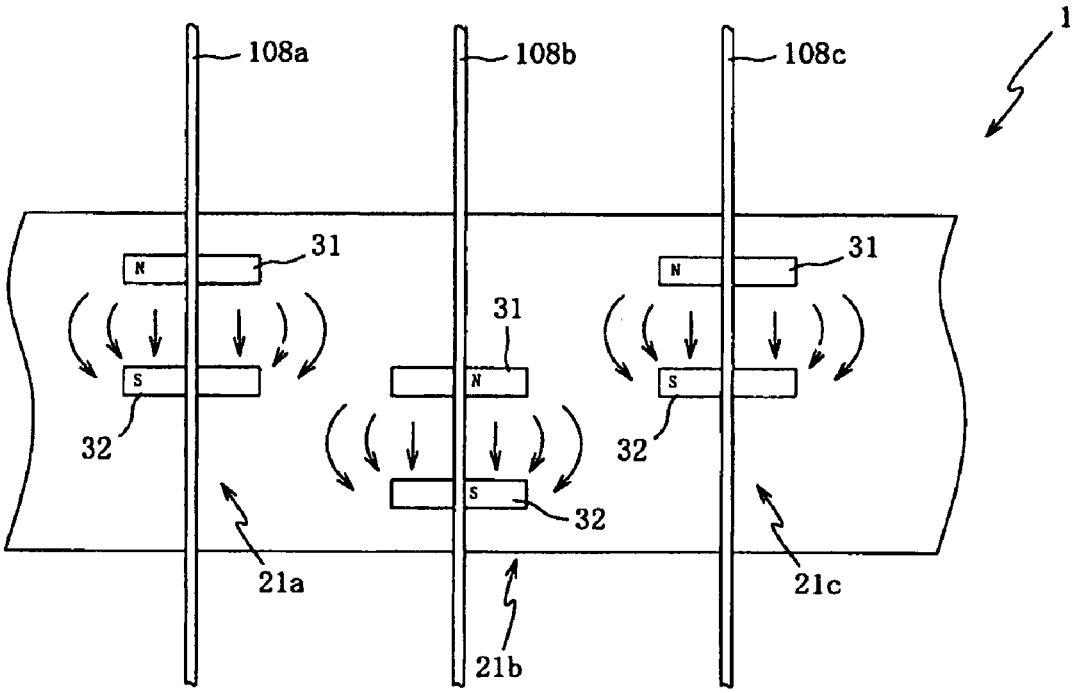
Figure 4:
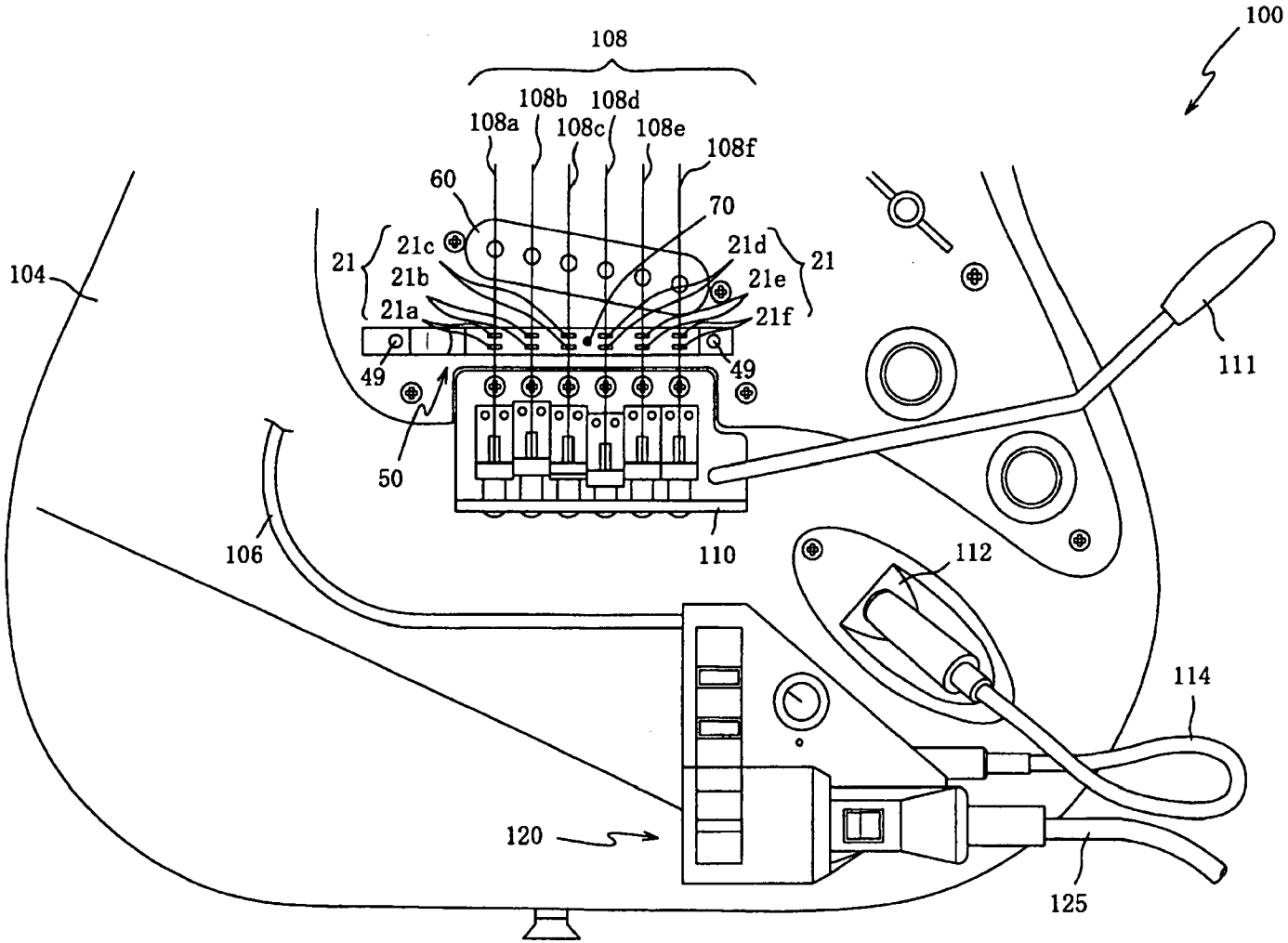
FIG. 4 PRIOR ART
FIG. 4 is an external view drawing of an electric guitar on which a pickup apparatus of the prior art has been mounted.
Figure 5A:
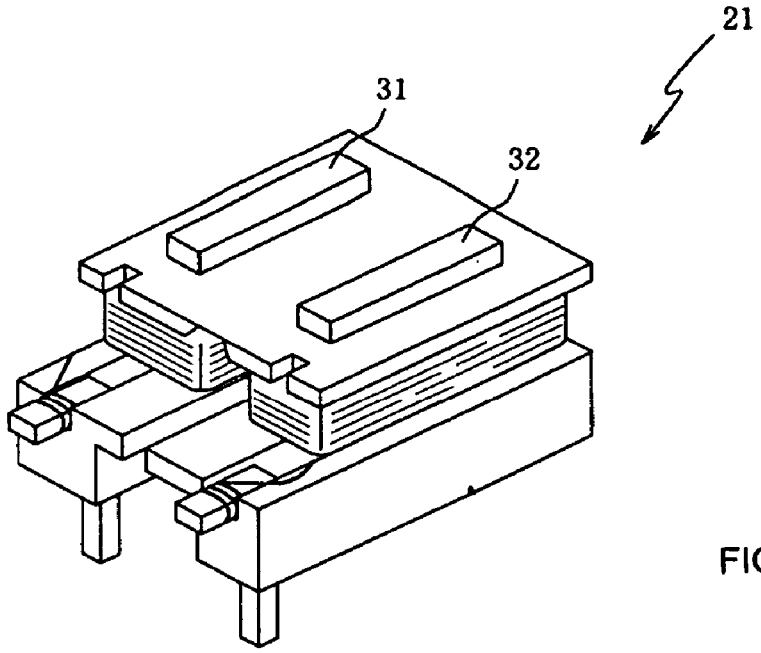
FIG. 5 shows the pickup apparatus of the prior art.
Figure 5B:
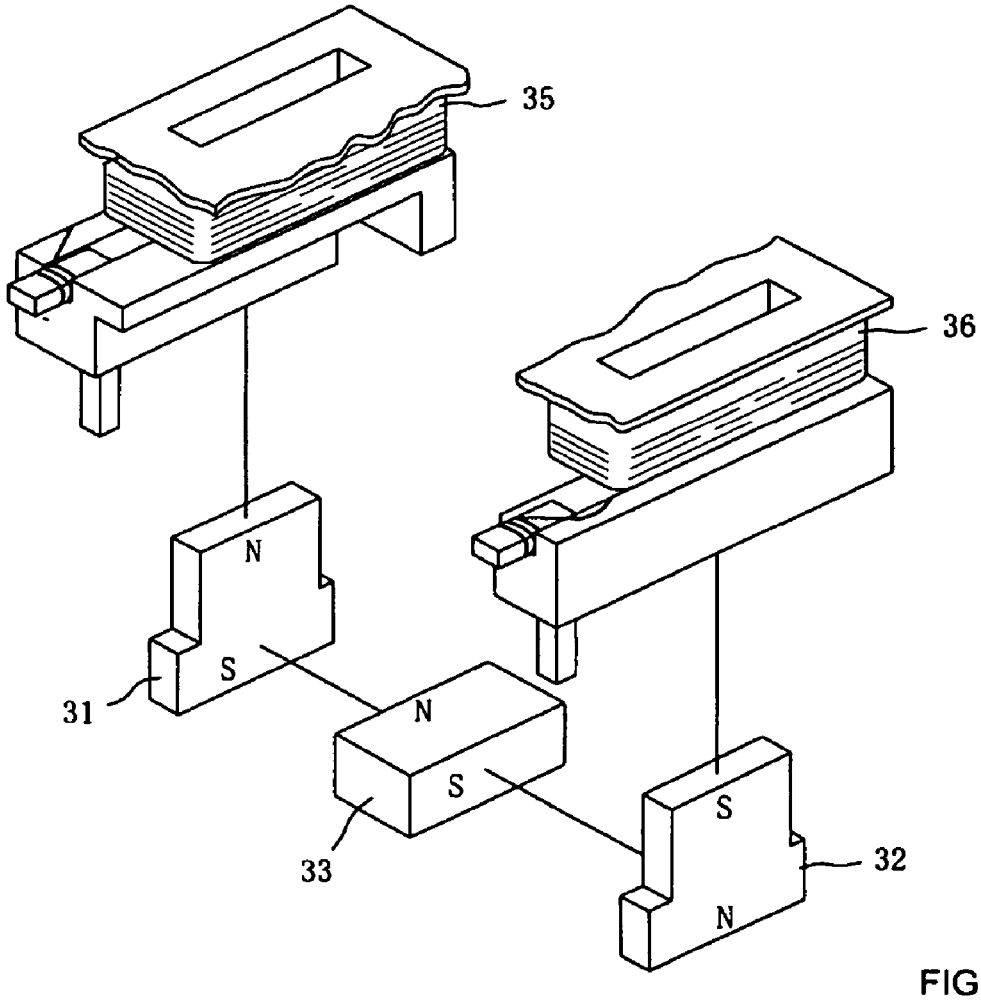
Figure 6:
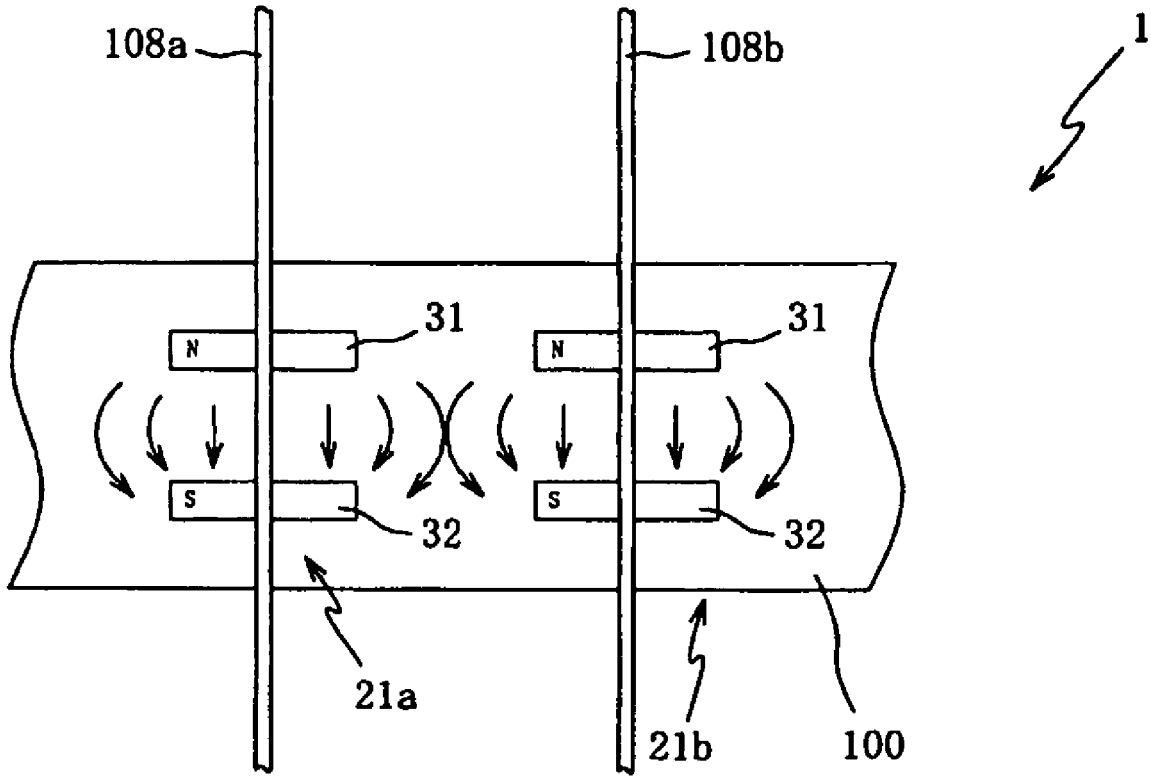
FIG. 6 PRIOR ART
FIG. 6 is a planar drawing that shows a condition of the magnetic fields of adjacent pickups for the pickup apparatus in FIG. 5.

FIG. 3(*a*) is a planar drawing of the pickup apparatus 1 that shows a second preferred embodiment of the present invention. In the first preferred embodiment, the six pickups 21*a* through 21*f* were arranged in roughly the same position along the length direction of the strings. In the second preferred embodiment, the adjacent pickups 21 are arranged in different positions along the length direction of the strings. L1 is the distance between pole piece 31 and pole piece 32 of each pickup 21, and L2 is the distance between the center of pickup 21*a* and the center of pickup 21*b* along the length direction of the strings. The pickups are positioned such that the distance L2 is greater than the distance L1.

In this embodiment, since the gaps between the magnetic force lines formed by the pickups 21 are large, it is possible to further reduce the mutually effects between the different pickups.

FIG. 3(*b*) is a planar drawing of the pickup apparatus 1 of a third preferred embodiment. In the first and the second preferred embodiments, the directions that the two pole pieces face each other are arranged having a specific angle with respect to length direction of the strings. In the third preferred embodiment, the pickups 21 are arranged such that the directions that the two pole pieces of the pickups 21 face each other coincide with each other and the length direction of the strings. Furthermore, adjacent pickups 21 are arranged in different positions along the length direction of the strings. In an example of the present embodiment shown in FIG. 3(*b*), the pole piece 32 (S pole) of the pickup 21*a* and the pole piece 31 (N pole) of the pickup 21*b* are arranged perpendicular to the strings. Since by this means, the strings vibrate in the same direction as the direction where the magnetic force line density formed by the pole pieces 31 and 32 is the highest, a high output can be obtained. At the same time, because the magnetic fields that are formed by adjacent pickups 21 are separated, it is possible to minimize the crosstalk.

In addition, in the embodiments shown in FIGS. 3(*a*) and 3(*b*), a plurality of three or more pickups 21 are arranged in alternating positions (in a zigzag form) along the length direction of the strings. This has the result of forming a pickup apparatus with a narrow width in the length direction of the strings as compared to the case in which the pickups are arranged with the positions shifted in one direction in order. Therefore, the pickup apparatus in the second and third embodiments can even be mounted on an electric guitar in which the space between the existing pickup apparatus 60 and bridge 110 is narrow.

An explanation of the present invention was given above of the present invention based on several preferred embodiments. However, the present invention is in no way limited to the preferred embodiments described above. Various modifications and changes that do not deviate from and are within the scope of the essentials of the present invention can be easily surmised.

For example, in the preferred embodiments described above, the pickup apparatus in accordance with the present invention was applied to the electric guitar 20 but the apparatus may also be applied to an electric bass, an electric piano, an electric Taisho harp, and the like.

In addition, in the preferred embodiments described above, the N pole (pole piece 31) and the S pole (pole piece 32) of adjacent pickups are arranged in the same position with respect to the bridge side. In other embodiments, the pole pieces may be arranged alternating. In other words, it may be set up such that the pickup of the first string has the N pole on the far side of the bridge and the S pole close to the bridge, while the pickup of the second string has the S pole on the far side of the bridge and the N pole close to the bridge.

What is claimed is:

1. A pickup apparatus comprising a plurality of pickups that each faces one of a plurality of strings and independently detects the vibrations of each string;

wherein each of said plurality of pickups is a humbucking type pickup comprising two magnetic poles composed of an N pole and an S pole;

wherein the two magnetic poles of each pickup face the string, and the direction that the two magnetic poles face each other forms an angle of at least 20 degrees with respect to a length direction the strings; and, wherein adjacent pickups are arranged having said angle such that the directions that the two magnetic poles face each other are mutually reciprocal with respect to the length direction the strings.

2. The pickup apparatus according to claim 1, wherein adjacent pickups are arranged in positions that differ by at least the amount of the distance between the two magnetic poles along the length direction of the strings.

3. A pickup apparatus comprising a plurality of four or more pickups that each faces one of a plurality of strings and independently detects the vibrations of each string;

wherein each of said plurality of pickups is a humbucking type pickup that has two magnetic poles composed of an N pole and an S pole;

wherein the two magnetic poles of each pickup face the string; and, wherein adjacent pickups are arranged in positions that differ by at least the amount of the distance between the two magnetic poles along a length direction of the strings.

4. A method of arranging pickups on a musical instrument having a plurality of strings, the method comprising:

providing a plurality of pickups, each pickup having an N magnetic pole and an S magnetic pole and defining a linear direction from the N magnetic pole to the S magnetic pole;

locating each pickup of the plurality of pickups adjacent to a respective one of the strings of a musical instrument;

arranging the pickups in directions relative to strings such that the linear direction from the N magnetic pole to the S magnetic pole of at least one pickup is at an acute angle with respect to the respective string adjacent to said at least one pickup.

5. The method according to claim 4, wherein arranging the pickups comprises:

arranging the pickups such that the linear direction from the N magnetic pole to the S magnetic pole of each of the plurality of pickups is at an acute angle relative to its respective string.

6. The method according to claim 5 wherein the plurality of strings are arranged adjacent to each other and wherein arranging the pickups comprises:

arranging the pickups such that the acute angle of each pickup is in a rotational direction relative to its respective string that is an opposite rotational direction compared to the rotational direction of the acute angle of the pickup associated with an adjacent string.

7. The method according to claim 4, wherein the acute angle is equal to or greater than 20 degrees.

8. The method according to claim 4, wherein the acute angle is approximately 30 degrees.

9. The method according to claim 4, wherein providing a plurality of pickups comprises providing at least one humbucking type pickup having:

an N pole piece that faces the associated string;

an S pole piece that faces the associated string;

a first coil surrounding the periphery of the N pole piece;

a second coil surrounding the periphery of the S pole piece; and, a permanent magnet that links the N pole piece and the S pole piece;

wherein the first coil and the second coil are wound in mutually opposite directions and are connected in series.

10. The method according to claim 4, wherein providing a plurality of pickups comprises providing at least one pickup having two magnets, wherein one of the two magnets form the N magnetic pole and other of the two magnets form the S magnetic pole of the pickup.

11. The method according to claim 4 wherein the plurality of strings are arranged adjacent to each other and wherein locating each pickup comprises:

disposing each pickup at a position along the length of an associated respective one of the strings such that at least one pickup is offset along the length of its associated string relative to a pickup associated with an adjacent string.

12. The method according to claim 11, wherein providing a plurality of pickups comprises providing at least first, second and third pickups each associated with a respective string of the plurality of strings, wherein the second pickup is associated with a string located between the strings associated with the first and third pickups; and wherein disposing each pickup comprises disposing the first and third pickups at locations that are offset in a common direction relative to the location of the second pickup.

13. The method according to claim 11, wherein providing a plurality of pickups comprises providing at least first, second and third pickups each associated with a respective string of the plurality of strings, wherein the second pickup is associated with a string located between the strings associated with the first and third pickups; and wherein disposing each pickup comprises disposing the first and third pickups at locations that are offset along the length of their associated strings relative to the location of the second pickup, but not offset relative to each other along the length of their associated strings.

14. The method according to claim 4, wherein the plurality of pickups comprises six pickups and the plurality of strings comprises six strings.

15. A method of arranging pickups on a musical instrument having a plurality of adjacent strings, the method comprising:

providing a plurality of magnetic pickups including first, second and third pickups, each pickup having an N pole and an S pole;

locating each pickup adjacent to an associated respective one of the plurality of strings such that second pickup is arranged adjacent to an associated string that is located between strings to which the first and third pickups are adjacent and associated; and arranging the pickups such that the locations of the first and third pickups are offset in a common direction along the length of their associated strings relative to the location of the second pickup along the length of its associated string.

16. The method according to claim 15 wherein arranging the pickups comprises arranging the first and third pickups to be offset relative to the second pickup, but not offset relative to each other.

17. The method according to claim 15, wherein providing a plurality of magnetic pickups comprises providing at least one humbucking type pickup having:

an N pole piece that faces the associated string;

an S pole piece that faces the associated string;

a first coil surrounding the periphery of the N pole piece;

a second coil surrounding the periphery of the S pole piece; and, a permanent magnet that links the N pole piece and the S pole piece;

wherein the first coil and the second coil are wound in mutually opposite directions and are connected in series.

18. A electronic stringed instrument, comprising:

a body;

a plurality of strings;

a plurality of pickups, each pickup having an N magnetic pole and an S magnetic pole and defining a linear direction from the N magnetic pole to the S magnetic pole;

wherein each pickup of the plurality of pickups is arranged adjacent to a respective one of the strings, in directions relative to strings such that the linear direction from the N magnetic pole to the S magnetic pole of at least one pickup is at an acute angle with respect to the respective string adjacent to said at least one pickup.

19. The instrument according to claim 18, wherein the pickups are arranged such that the linear direction from the N magnetic pole to the S magnetic pole of each of the plurality of pickups is at an acute angle relative to its respective string.

20. The instrument according to claim 19 wherein the plurality of strings are arranged adjacent to each other and wherein the pickups are arranged such that the acute angle of each pickup is in a rotational direction relative to its respective string that is an opposite rotational direction compared to the rotational direction of the acute angle of the pickup associated with an adjacent string.

21. The instrument according to claim 18, wherein the acute angle is equal to or greater than 20 degrees.

22. The instrument according to claim 18, wherein the acute angle is approximately 30 degrees.

23. The instrument according to claim 18, wherein the plurality of pickups comprises at least one humbucking type pickup having:

an N pole piece that faces the associated string;

an S pole piece that faces the associated string;

a first coil surrounding the periphery of the N pole piece;

a second coil surrounding the periphery of the S pole piece; and, a permanent magnet that links the N pole piece and the S pole piece;

wherein the first coil and the second coil are wound in mutually opposite directions and are connected in series.

24. The instrument according to claim 18, wherein the plurality of pickups comprises at least one pickup having two magnets, wherein one of the two magnets form the N magnetic pole and other of the two magnets form the S magnetic pole of the pickup.

25. The instrument according to claim 18 wherein the plurality of strings are arranged adjacent to each other and wherein each pickup is arranged at a position along the length of an associated respective one of the strings such that at least one pickup is offset along the length of its associated string relative to a pickup associated with an adjacent string.

26. The instrument according to claim 25, wherein the plurality of pickups comprises providing at least first, second and third pickups each associated with a respective string of the plurality of strings, wherein the second pickup is associated with a string located between the strings associated with the first and third pickups; and wherein the first and third pickups are arranged at locations along the lengths of their respective associated strings that are offset in a common direction relative to the location of the second pickup along the length of its respective associated string.

27. The instrument according to claim 25, wherein the plurality of pickups comprises providing at least first, second and third pickups each associated with a respective string of the plurality of strings, wherein the second pickup is associated with a string located between the strings associated with the first and third pickups; and wherein the first and third pickups are arranged at locations along the lengths of their respective associated strings that are not offset from each other, but are offset in a common direction relative to the location of the second pickup along the length of its respective associated string.

28. A electronic stringed instrument, comprising:

a body;

a plurality of strings; and a plurality of magnetic pickups including first, second and third pickups, each pickup having an N pole and an S pole, each pickup is located adjacent to an associated respective one of the plurality of strings such that second pickup is arranged adjacent to an associated string that is located between strings to which the first and third pickups are adjacent and associated; and wherein the pickups are arranged such that the locations of the first and third pickups are offset in a common direction along the length of their associated strings relative to the location of the second pickup along the length of its associated string.

29. The instrument according to claim 28 wherein the first and third pickups are arranged offset relative to the second pickup, but not offset relative to each other along the lengths of their respective associated strings.

30. The instrument according to claim 28, wherein the plurality of magnetic pickups comprises at least one humbucking type pickup having:

an N pole piece that faces the associated string;

an S pole piece that faces the associated string;

a first coil surrounding the periphery of the N pole piece;

a second coil surrounding the periphery of the S pole piece; and, a permanent magnet that links the N pole piece and the S pole piece;

wherein the first coil and the second coil are wound in mutually opposite directions and are connected in series.

* * * * *